US007837440B2

(12) United States Patent
Bunker et al.

(10) Patent No.: US 7,837,440 B2
(45) Date of Patent: Nov. 23, 2010

(54) TURBINE BUCKET TIP CAP

(75) Inventors: Ronald S. Bunker, Niskayuma, NY (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 325 days.

(21) Appl. No.: 11/160,272

(22) Filed: Jun. 16, 2005

(65) Prior Publication Data

US 2006/0285974 A1 Dec. 21, 2006

(51) Int. Cl.
*F01D 5/08* (2006.01)

(52) U.S. Cl. ..... 416/96 R; 416/97 R

(58) Field of Classification Search ..... 416/96 R, 416/97 R, 92; 415/115, 178; 165/80.3, 80.4
See application file for complete search history.

(56) References Cited

U.S. PATENT DOCUMENTS

| | | | | |
|---|---|---|---|---|
| 3,677,331 | A * | 7/1972 | Lund et al. | 164/122 |
| 5,772,397 | A * | 6/1998 | Morris et al. | 415/115 |
| 6,087,059 | A * | 7/2000 | Duggan et al. | 430/108.22 |
| 6,174,133 | B1 | 1/2001 | Bunker | 416/97 R |
| 6,224,336 | B1 * | 5/2001 | Kercher | 416/97 R |
| 6,244,331 | B1 * | 6/2001 | Budelman | 165/80.3 |
| 6,261,054 | B1 | 7/2001 | Bunker | 415/115 |
| 6,273,186 | B1 * | 8/2001 | Ognibene et al. | 165/185 |
| 6,290,462 | B1 * | 9/2001 | Ishiguro et al. | 416/97 R |
| 6,347,923 | B1 * | 2/2002 | Semmler et al. | 416/97 R |
| 6,506,022 | B2 | 1/2003 | Bunker | 416/97 R |
| 6,595,748 | B2 * | 7/2003 | Flodman et al. | 416/97 R |
| 6,729,383 | B1 * | 5/2004 | Cannell et al. | 165/80.3 |
| 6,984,102 | B2 * | 1/2006 | Bunker et al. | 415/115 |
| 2002/0182074 | A1 | 12/2002 | Bunker | 416/97 |
| 2003/0026698 | A1 | 2/2003 | Flodman | |
| 2005/0238488 | A1 | 10/2005 | Eastman | |
| 2006/0008350 | A1 | 1/2006 | Chlus et al. | |
| 2006/0257256 | A1 | 11/2006 | Eastman et al. | |

FOREIGN PATENT DOCUMENTS

| | | |
|---|---|---|
| EP | 1614860 | 1/2006 |
| JP | 08240102 | 9/1996 |
| JP | 2001107701 | 4/2001 |

* cited by examiner

*Primary Examiner*—Ninh H Nguyen
(74) *Attorney, Agent, or Firm*—Sutherland Asbill & Brennan LLP

(57) ABSTRACT

A tip cap piece for use in a turbine bucket. The tip cap piece may include a cold side and a number of pins positioned on the cold side.

20 Claims, 4 Drawing Sheets

TURBINE BUCKET TIP CAP

TECHNICAL FIELD

The present invention relates generally to turbine engines and more particularly to turbine blade tip cooling.

BACKGROUND OF THE INVENTION

In a gas turbine engine, air is pressurized in a compressor and mixed with fuel and ignited in a combustor for generating hot combustion gases. The gases flow through turbine stages that extract energy therefrom for powering the compressor and producing useful work.

A turbine stage includes a row of turbine buckets extending outwardly from a supporting rotor disk. Each bucket includes an airfoil over which the combustion gases flow. The airfoil is generally hollow and is provided with air bled from the compressor for use as a coolant during operation. The airfoil needs to be cooled to withstand the high temperatures produced by the combustion. Insufficient cooling may result in undo stress on the airfoil that over time may lead or contribute to fatigue. Existing cooling configurations include air cooling, open circuit cooling, close circuit cooling, and film cooling.

All regions of the bucket exposed to the hot gas flows must be cooled. Bucket internal tip turn regions, and the tip caps specifically, generally use smooth internal surfaces that are naturally augmented, in terms of the enhanced heat transfer coefficients, due to three dimensional flow turning and pseudo-impingement. The use of film cooling and tip bleed holes can increase cooling of these regions, but are restricted to open-circuit, air-cooled designs. Internal convective cooling is the primary cooling means in all designs. Turning flow-induced secondary flows in the tip turn regions may serve to lessen the natural cooling augmentation noted, due to the radial inflow motion of the secondary flow.

Another cooling method involves placing turbulators on the major adjacent walls (inside of the airfoil pressure and suction surfaces) through the turn regions to provide heat transfer augmentation on all surfaces. These turbulators are not placed on the tip cap surface itself. Other designs use a turning vane in the turn path to direct further cooling flow at the tip cap surface, or to avoid low velocity flows in corners. These turning vanes are positioned as connecting elements between the pressure and suction side internal surfaces, again not on the tip cap surfaces.

There is a desire, therefore, for improved cooling for turbine bucket tips or tip caps. The improvements may be applicable to closed circuit and open circuit tips.

SUMMARY OF THE INVENTION

The present application thus describes a tip cap piece for use in a turbine bucket. The tip cap piece may include a cold side and a number of pins positioned on the cold side.

The pins may be made out of materials such as nickel-based or cobalt-based alloys. Each of the pins may include a base fillet and an elongated top. The pins may have a height to diameter ratio of about two (2) to about four (4). The pins may have a height of about 0.02 inches (about 0.5 millimeters) to about 0.10 inches (about 2.5 millimeters) with a base width that includes the fillet of about two (2) to about four (4) times the height.

The number of pins may be positioned in a staggered array. The pins may be positioned about 0.1 inches (about 2.5 millimeters) away from each other along a diagonal. The pins may have a pin spacing to diameter ratio of about four (4).

The cold side may include a peripheral area without any pins. The cold side may include a rib positioned thereon.

The present application further may describe a tip cap piece for use in a turbine bucket. The tip cap piece may include a cold side and a number of pins positioned on the cold side. The pins each may include a base fillet, an elongated top, and a height to diameter ratio of about two (2) to about four (4).

The pins may have a height of about 0.02 inches (about 0.5 millimeters) to about 0.10 inches (about 2.5 millimeters) with a base width that includes the fillet of about two (2) to about four (4) times the height.

The pins may be positioned in a staggered array. Each of the pins may be position about 0.1 inches (about 2.5 millimeters) away from each other along a diagonal. The pins may have a pin spacing to diameter ratio of about four (4).

The present application further may describe a tip cap piece for use in a turbine bucket. The tip cap piece may include a number of pins and a rib positioned within the pins. Each of the pins may include a base fillet and an elongated top. The pins may have a height to diameter ratio of about two (2) to about four (4). The pins may be positioned in a staggered array with a pin spacing to diameter ratio of about four (4).

These and other features of the present invention will become apparent to one of ordinary skill in the art upon review of the following detailed description of the preferred embodiments when taken in conjunction with the drawings and the appended claims.

DETAILED DESCRIPTION

Figure 1:
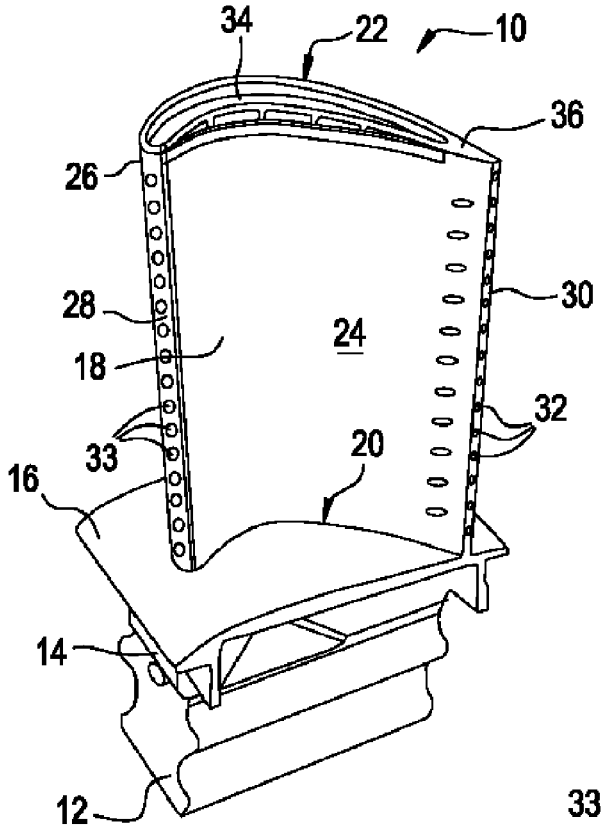
FIG. 1 is a perspective view of a turbine bucket for use herein.

Referring now to the drawings, in which like numerals refer to like parts throughout the several views, FIG. 1 depicts an example of a turbine bucket 10. The bucket 10 preferably is formed as a one piece casting of a super alloy. The turbine bucket 10 includes a conventional dovetail 12. The dovetail 12 attaches to a conventional rotor disk (not shown). A blade shank 14 extends upwardly from the dovetail 12 and terminates in a platform 16 that projects outwardly from and surrounds the shank 14.

A hollow airfoil 18 extends outwardly from the platform 16. The airfoil 18 has a root 20 at the junction with the platform 16 and a tip 22 at its outer end. The airfoil 18 has a concave pressure sidewall 24 and a convex suction sidewall 26 joined together at a leading edge 28 and a trailing edge 30. The airfoil 18, however, may take any configuration suitable for extracting energy from the hot gas stream and causing rotation of the rotor disk. The airfoil 18 may include a number of trailing edge cooling holes 32 and a number of leading edge cooling holes 33. A tip cap 34 may close off the tip 22 of the airfoil 18. The tip cap 34 may be integral to the airfoil 18 or separately formed and attached to the airfoil 18. A squealer tip 36 may extend outwardly from the tip cap 34.

Figure 2:
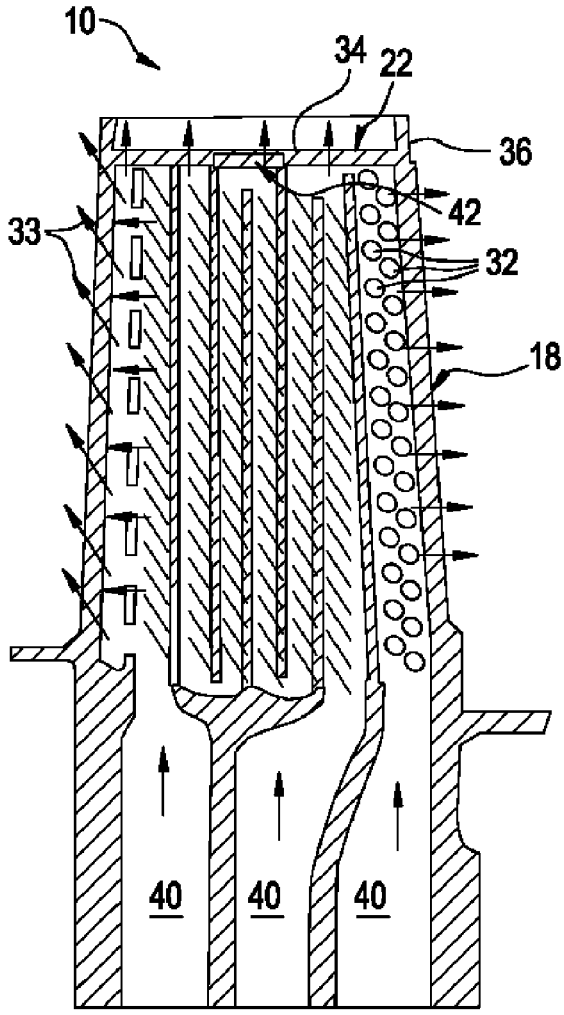
FIG. 2 is a side cross-sectional view of a turbine bucket for use herein.
Figure 3:
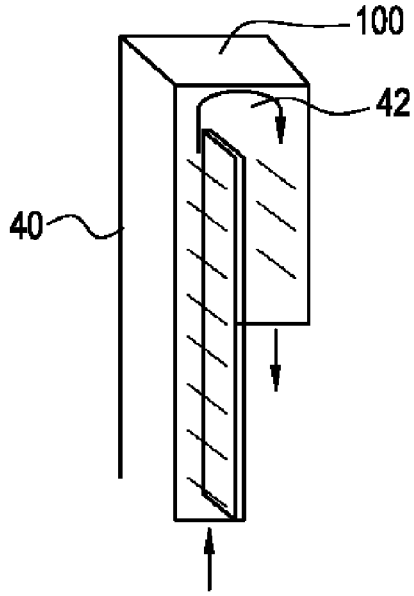
FIG. 3 is a side cross-sectional view of an internal channel within the turbine bucket of FIG. 2.

FIG. 2 shows a side cross-sectional view of an airfoil 18 for use with the present invention. Numerous airfoil designs, however, may be used herein. As is shown, the airfoil 18 has a number of internal cooling pathways 40. The airfoil 18 may be air-cooled, steam cooled, open circuit, or closed circuit. As is shown in FIG. 3, the cooling pathways 40 may include internal tip turn regions 42 located near the tip cap 34. The internal pathways 40 may or may not be turbulated. Film cooling and tip fluid holes may be positioned about the internal tip turn regions 42 in open circuit, air-cooled designs.

Figure 4:
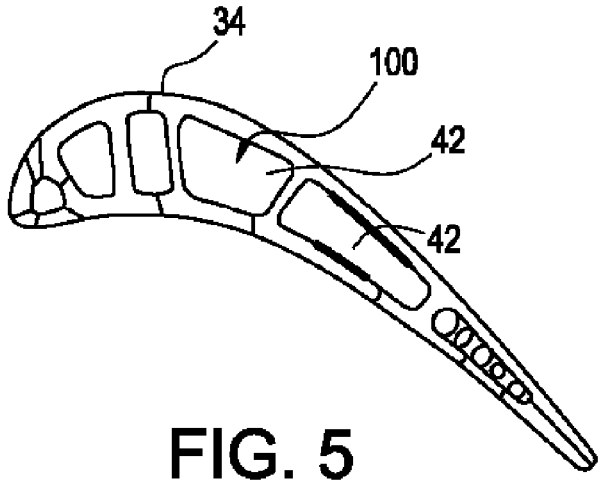
FIG. 4 is a top plan view of the turbine bucket with a tip cap piece.
Figure 5:
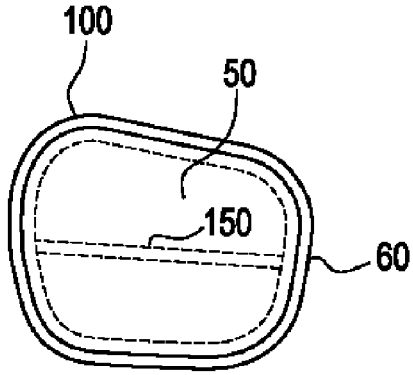
FIG. 5 is a top plan view of a tip cap piece as is described herein.

FIGS. 4-5 show the use of a tip cap piece 100 as is described herein. The tip cap piece 100 may be positioned within one of the internal tip turn regions 42 about the tip cap 34. As is shown, the tip cap piece 100 may include a hot side 50 exposed to the hot gases and a cold side 60. A typical tip cap piece 100 may be sized at about 1.2 inches (about 3 centimeters) by 1.4 inches (about 3.5 centimeters) and with a thickness of about 0.1 inches (about 2.5 centimeters), although any desired size or shape may be used. [These dimensions are for a large power turbine bucket. Smaller sizes would apply for smaller turbines.] The tip cap piece 100 fits within the tip cap 34 and may be attached by welding, brazing, or other types of conventional means.

Figure 6:
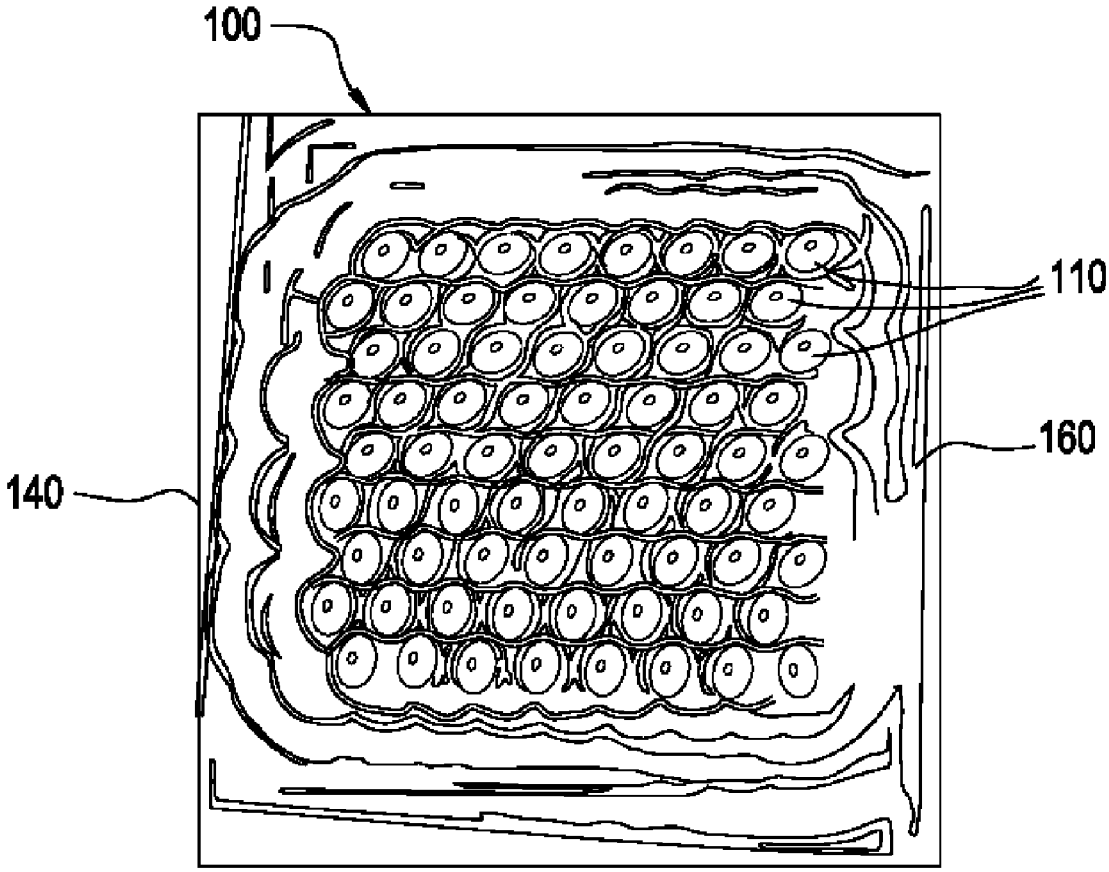
FIG. 6 is a top plan view of a pin array for use herein.
Figure 7:
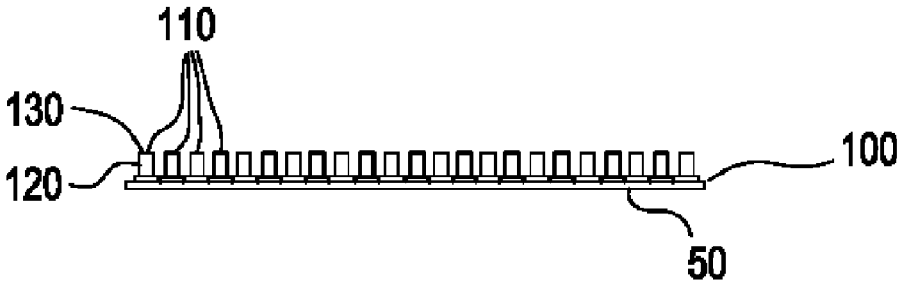
FIG. 7 is a side cross-sectional view of the pin array of FIG. 6.

As is shown in FIGS. 6 and 7, the tip cap piece 100 may include a number of tip cap pins 110 positioned on the cold side 60. The pins 110 preferably may be made from materials such as nickel-based or cobalt-based high temperature, high strength alloys. Each pin 110 may include a base fillet 120 and a top 130. The top 130 may be radiused. The pins 110 can be of varying cross-sectional shape, although circular and oblong are preferred. The pins 110 preferably have a height to diameter ratio of about two (2) to about four (4). For example, the pins 110 may have a cross-sectional diameter at the top 130 of about 0.035 inches (about 0.9 millimeters) and a height of about 0.070 inches (about 1.75 millimeters). Pin height may range from about 0.02 inches (about 0.5 millimeters) to about 0.10 inches (about 2.5 millimeters) or more with a corresponding base width that includes the fillet 120 having a dimension of between about two (2) to about four (4) times the height, or about 0.040 to about 0.08 inches (about 1.016 to about 2.032 millimeters).

The pins 110 may be fabricated by (1) separate formation of tip cap pieces 100 containing the augmented surfaces and subsequently welded, brazed, or joined such that the cold side 60 of both the tip cap piece 100 and the tip cap 34 are aligned as one or (2) integrally casting the augmented surfaces in the bucket casting. For separate pieces, as well as the open portion of cast tips, surfaces may be cast, machined by methods such as EDM (electro-discharge machining), or conventionally milled by CNC. Other fabrication methods may be used herein.

The pins 110 may be positioned in a staggered array as is shown or in any desired configuration. For example, the tops 130 of the pins 110 may be spaced about 0.10 inches (about 2.5 millimeters) from each other along a diagonal. An effective pin spacing to diameter ratio may be about four (4). The size and positioning of the pins 110 may vary. Decreasing the spacing between the pins 110 by adding more pins 110 may actually decrease the overall heat flux enhancement. Closer spacing of the pins 110 may reduce the formation and intensity of individual wake regions and the accompanying benefit to heat transfer.

As is shown in FIG. 6, the pins 110 may be positioned about the center of the tip cap piece 100 (or the center of the completed tip turn region 42 with the tip cap 100 in place) thus leaving a peripheral area 140. Although the overall area of pin placement is reduced, the heat flux enhancement remains about the same in and adjacent to the regions with the pins. The peripheral area 140 without the pins 110 (which is part of the casting) may be used such that the tip cap piece 110 may be welded or brazed into the tip cap 34.

Figure 8:
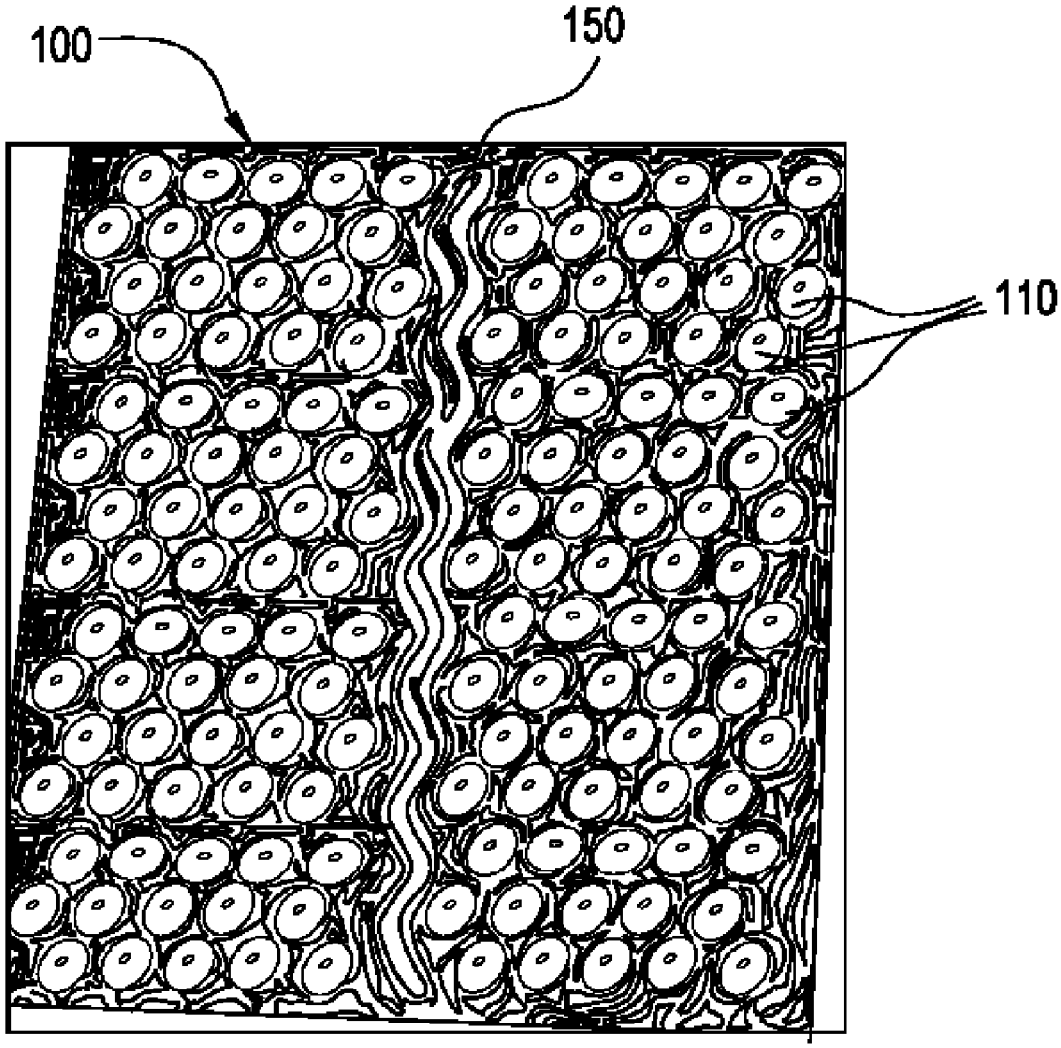
FIG. 8 is an alternative embodiment of the pin array with a central rib.

FIG. 8 shows an alternative embodiment of the tip cap piece 100. In this embodiment, a rib 150 may be positioned within the pins 110. The rib 150 serves to provide additional mechanical strength to the tip cap piece 100. The rib 150 may take any desired shape. More than one rib 150 may be used. The rib 150 may extend in the bucket chordal direction. The rib 150 may be integrally formed in the cold side 60 of the tip cap piece 100.

In use, the short height to diameter ratio of about two (2) to four (4) provides that the majority of the pin 110 and base fillet 120 surface area is effective as heat transfer wetted area, about ninety percent (90%) to about seventy percent (70%). The placement of the pins 110 on the internal tip turn regions 42 allows a combination of impingement and cross-flow convection. This combination generates flow mixing and turbulence on the local level and as interactions as an array. The flow-surface interaction serves to disrupt the secondary flows that otherwise would decrease heat transfer. Further, the tops 130 of the pins 110 provide effective shear flows and turbulence capable of further impacting heat transfer on the cold side 60 of the tip cap 34. Results show a cooling heat flux augmentation of 2.25 can be obtained relative to the smooth surface heat flux in the same turn geometry. Adjacent weld region heat transfer coefficient enhancement of over seventy percent (+70%) compared to a non-augmented surface can be realized. There generally is no pressure loss penalty associated with these augmentations.

Generally, the augmented surface coefficients are about two (2) times or higher compared to the smooth surface result. A heat transfer augmentation of about two (2) is still achieved even with a limited placement of pins 110 as is shown in FIG. 6.

It should be apparent that the foregoing relates only to the preferred embodiments of the present invention and that numerous changes and modifications may be made herein without departing from the general spirit and scope of the invention as defined by the following claims and the equivalents thereof.

What is claimed is:

1. A system for use in a turbine bucket, the turbine bucket having a cooling pathway, the system comprising, a tip cap piece that at least partially closes the cooling pathway, the tip cap piece comprising a cold side positioned adjacent to the cooling pathway; and a plurality of free pins positioned as an array on at least a central portion of the cold side, each pin attached directly to a surface of the cold side and extending into the cooling pathway, each pin completely surrounded by an air gap adjacent to the cold side.

2. The tip cap piece of claim 1, wherein each of the plurality of pins comprises a base fillet and an elongated top.

3. The tip cap piece of claim 1, wherein the plurality of pins comprises a nickel-based or cobalt-based alloy.

4. The tip cap piece of claim 1, wherein the plurality of pins comprises a height to diameter ratio of about two (2) to about four (4).

5. The tip cap piece of claim 1, wherein each of the plurality of pins comprises a height of about 0.02 inches (about 0.5 millimeters) to about 0.10 inches (about 2.5 millimeters) and a base width of about two (2) to about four (4) times the height.

6. The tip cap piece of claim 1, wherein the plurality of pins comprises a staggered array.

7. The tip cap piece of claim 1, wherein each of the plurality of pins comprises a position of about 0.1 inches (about 2.5 millimeters) away from each other along a diagonal.

8. The tip cap piece of claim 1, wherein the plurality of pins comprises a pin spacing to diameter ratio of about four (4).

9. The tip cap piece of claim 1, wherein the cold side comprises a peripheral area without the plurality of pins.

10. The tip cap piece of claim 1, further comprising a rib positioned within the array, the rib attached directly to the surface of the cold side.

11. A system for use in a turbine bucket, the turbine bucket having a cooling pathway, the system comprising, a tip cap piece that at least partially closes the cooling pathway, the tip cap piece comprising a cold side positioned adjacent to the cooling pathway; and a plurality of free pins positioned as an array on at least a central portion of the cold side, each pin attached directly to a surface of the cold side and extending into the cooling pathway, each pin completely surrounded by an air gap adjacent to the cold side;

wherein each of the plurality of pins comprises a base fillet, an elongated top, and a height to diameter ratio of about two (2) to about four (4).

12. The tip cap piece of claim 11, wherein each of the plurality of pins comprises a height of about 0.02 inches (about 0.5 millimeters) to about 0.10 inches (about 2.5 millimeters) and a base width of about two (2) to about four (4) times the height.

13. The tip cap piece of claim 11, wherein the plurality of pins comprises a staggered array.

14. The tip cap piece of claim 11, wherein each of the plurality of pins comprises a position of about 0.1 inches (about 2.5 millimeters) away from each other along a diagonal.

15. The tip cap piece of claim 11, wherein the plurality of pins comprises a pin spacing to diameter ratio of about four (4).

16. A system for use in a turbine bucket, the turbine bucket having a cooling pathway, the system comprising, a tip cap piece that at least partially closes the cooling pathway, the tip cap piece comprising a cold side positioned adjacent to the cooling pathway; and a plurality of free pins positioned as an array on at least a central portion of the cold side, each pin attached directly to a surface of the cold side and extending into the cooling pathway, each pin surrounded by an air gap adjacent to the cold side; and a rib positioned within the array and attached directly to the surface of the cold side.

17. The tip cap piece of claim 16, wherein each of the plurality of pins comprises a base fillet and an elongated top.

18. The tip cap piece of claim 16, the plurality of pins comprises a height to diameter ratio of about two (2) to about four (4).

19. The tip cap piece of claim 16, wherein the plurality of pins comprises a staggered array.

20. The tip cap piece of claim 16, wherein the plurality of pins comprises a pin spacing to diameter ratio of about four (4).

* * * * *